US010710079B2

(12) United States Patent
Kaigala et al.

(10) Patent No.: US 10,710,079 B2
(45) Date of Patent: Jul. 14, 2020

(54) ELECTRO-KINECTIC DEVICE FOR SPECIES EXCHANGE

(71) Applicants: International Business Machines Corporation, Armonk, NY (US); Technion Research and Development Foundation Ltd., Haifa (IL)

(72) Inventors: Govind Kaigala, Pfäffikon (CH); Nadya Ostromohov, Haifa (IL); Moran Bercovici, Haifa (IL)

(73) Assignees: INTERNATIONAL BUSINESS MACHINES CORPORATION, Armonk, NY (US); Technion Research and Development Foundation Ltd., Haifa (IL)

( * ) Notice: Subject to any disclaimer, the term of this patent is extended or adjusted under 35 U.S.C. 154(b) by 161 days.

(21) Appl. No.: 16/015,864

(22) Filed: Jun. 22, 2018

(65) Prior Publication Data

US 2019/0001334 A1 Jan. 3, 2019

Related U.S. Application Data

(60) Provisional application No. 62/526,378, filed on Jun. 29, 2017.

(51) Int. Cl.
*B01L 3/00* (2006.01)

(52) U.S. Cl.
CPC ..... *B01L 3/502784* (2013.01); *B01L 3/5088* (2013.01); *B01L 2200/026* (2013.01);
(Continued)

(58) Field of Classification Search
CPC ..... B01L 3/502784
See application file for complete search history.

(56) References Cited

U.S. PATENT DOCUMENTS 8,702,948 B2 4/2014 Ronaghi et al.
8,821,796 B2 * 9/2014 Peng ..... G01N 33/48721 422/82.03

(Continued)

OTHER PUBLICATIONS

G.V. Kaigala, A Vertical Microfluidic Probe, 27 Langmuir 2011, p. 5686-93. (Year: 2011).*

(Continued)

*Primary Examiner* — Luan V Van
*Assistant Examiner* — Caitlyn Mingyun Sun
(74) *Attorney, Agent, or Firm* — Cantor Colburn LLP; Daniel Morris

(57) ABSTRACT

A scanning micro-fluid device for an exchange of species with a surface and with an intermediate immersion liquid is disclosed. The device comprises a first and a second micro-channel comprising a fluid. The first micro-channel comprises a first aperture and the second micro-channel comprises a second aperture. They have a distance to each other in an apex area in proximity of the surface of a substrate. The surface, the apex area is immersed with the intermediate immersion liquid. The device also comprises a first electrode reaching into the fluid on the first micro-channel and a second electrode reaching into the fluid on the second micro-channel, and an apex electrode. Different voltage levels are applicable to the first, the second and the apex electrode such that species are interacting at surface of the substrate.

20 Claims, 6 Drawing Sheets

(52) U.S. Cl.
CPC ... *B01L 2200/0673* (2013.01); *B01L 2200/16* (2013.01); *B01L 2400/0418* (2013.01); *B01L 2400/0421* (2013.01)

(56) References Cited

U.S. PATENT DOCUMENTS

| | | | | |
|---|---|---|---|---|
| 8,940,102 | B2 | 1/2015 | Greeley et al. | |
| 9,168,527 | B2 | 10/2015 | Robinson et al. | |
| 9,207,684 | B2 * | 12/2015 | Delamarche | G05D 7/0694 |
| 9,671,366 | B2 * | 6/2017 | Orwar | B01L 3/022 |
| 2010/0252434 | A1 | 10/2010 | Roy | |
| 2013/0333761 | A1 * | 12/2013 | Delamarche | B01L 3/502707 137/1 |
| 2014/0166483 | A1 | 6/2014 | Chow et al. | |

OTHER PUBLICATIONS

F. Cortes-Salazar, Fountain pen for scanning electrochemical microsopy, 2 Analytical Methods 2010, p. 807-13. (Year: 2010).*

T.W. Spaine, A Positionable Microcell for Electrochemical and Scanning Electrochemical Microscopy in Subnanoliter Volumes, 73, Analytical Chemistry, 2001, p. 930-38. (Year: 2001).*

A. Bondarendo, Electrochemical Push-Pull Probe: From Scanning Electrochemical Microscopy to Multimodal Altering of Cell Microenvironment, 87, Analytical Chemistry, 2015, p. 4479-86. (Year: 2015).*

D. Juncker, Multipurpose microfluidic probe, 4 Nature Materials, Aug. 2005, p. 622-28. (Year: 2015).*

A. Kashyap Selective locally lysis and sampling of live cells for nucleic acid analysis using a microfluidic probe, 6 Scientific Reports, 2016, 29579, p. 1-10. (Year: 2016).*

M. Safavieh, Two-Aperture Microfluidic Probes as Flow Dipoles: Theory and Applications, 5 Scientific Reports, 2015, 11943, p. 1-15. (Year: 2015).*

Beskok et al., "Electrokinetic Transport Phenomena in Micro-Fluidics," Micromechanics and Nanoscale Effects, 2004, pp. 81-82.

Gu et al., "The ζ-Potential of Glass Surface in Contact with Aqueous Solutions," Journal of Colloid and Interface Science 226.2, 2000, pp. 328-339.

Milanova et al., "Electrophoretic mobility measurements of fluorescent dyes using on-chip capillary electrophoresis," Electrophoresis 32.22, 2011, pp. 3286-3294.

Shackman et al., "Gradient elution moving boundary electrophoresis for high-throughput multiplexed microfluidic devices," Analytical Chemistry 79.2, 2007, 20 pages.

* cited by examiner

ELECTRO-KINECTIC DEVICE FOR SPECIES EXCHANGE

DOMESTIC PRIORITY

This application claims priority to U.S. Application Ser. No. 62/526,378, filed Jun. 29, 2017, the contents of which are incorporated by reference herein in its entirety.

STATEMENT REGARDING FEDERALLY SPONSORED RESEARCH OR DEVELOPMENT

The work leading to this invention has received funding from the European Community's Seventh Framework Programme FP7/2007-2013 under grant agreement PITN-GA-2013-607322.

BACKGROUND

The invention relates generally to a scanning micro-fluid device, and more specifically, to a scanning micro-fluid device for an exchange of species with a surface and an intermediate immersion liquid. The invention relates further to a method for an exchange of species with a surface and a related method.

Local processing of substrates is required in various applications including biology, chemistry, medicine, biotechnology, optics, microfabrication, electronics and materials science and engineering. Such processing involves locally altering a substrate for additive patterning or extraction of molecules by confining the contact of reagents to a limited area on the sample. These reagents may be delivered to the substrate by fluid motion or electro-kinetic transport. In particular, local processing and analysis of samples at the microscale is advantageous in biological applications, in which standard samples include tissue sections, adherent cells, and DNA or protein microarrays.

Electro-kinetic transport is beneficial for processing and analysis of biological samples at the micrometer and submicrometer scale due to the dominance of electro-kinetic phenomena at these scales and their compatibility with microfluidic devices. Furthermore, electro-kinetic phenomena are commonly used to manipulate analytes, as biological cells and most biomolecules are electrically charged, and are directly affected by an interaction with electric fields. For example, interactions with cell membrane leading to electroporation, focusing, separation and mixing of analytes.

Two common transport mechanisms occur when an electric field is applied which are electrophoresis and electro-osmosis. Electrophoresis refers to motion of ions in solution under the influence of an external electric field. The velocity of the ion migration is proportional to the applied electric field. The proportion coefficient is termed electrophoretic mobility and depends on the ion charge and the viscosity of the fluid. Electro-osmosis refers to bulk fluid motion, occurring when electric fields are applied across microfluidic channels or capillaries. This Velocity depends on the material the walls of the micro-channel are constructed of and the solution that comes in contact with the walls. This fluid motion is called electro-osmosis, or electroosmotic flow (EOF), and the proportion coefficient to the electric field is the electroosmotic mobility. EOF occurs as a result of electrical forces exerted on ions in the electric double layer (EDL) in the liquid adjacent to the wall.

SUMMARY

According to aspects of the present invention, a scanning micro-fluid device for an exchange of species with a surface and an intermediate immersion liquid may be provided. The device may comprise a first micro-channel comprising a fluid and a second micro-channel comprising the fluid. The first micro-channel may comprise at its first end a first aperture, and the second micro-channel may comprise at its first end a second aperture. The first and the second aperture may comprise a distance to each other in an apex area in proximity of the surface of a substrate.

The surface, the apex area comprising the first aperture of the first micro-channel and a second aperture of the second micro-channel, may be immersed with the intermediate immersion liquid.

The device may further comprise a first electrode reaching into the fluid on the first micro-channel, a second electrode reaching into the fluid on the second micro-channel, and an apex electrode reaching into the apex area, wherein different voltage levels are applicable to the first, the second and the apex electrode. This way, the species may be exchangeable between the fluid of the first and the second micro-channel and the surface of the substrate.

According to another aspect of the present invention, a method for an exchange of species with a surface and an intermediate immersion liquid may be provided. The method may comprise providing a fluid in a first micro-channel and providing a second micro-channel comprising the fluid.

The first micro-channel may comprise at its first end a first aperture and the second micro-channel may comprise at its first end a second aperture. The first aperture and the second aperture may comprise a distance to each other in an apex area in proximity of the surface of a substrate.

The method may also comprise immersing the apex area with the intermediate immersion liquid, building a first electrical field between a first electrode reaching into the fluid of the first micro-channel and an apex electrode, the apex electrode reaching into the apex area, building a second electrical field between a second electrode reaching into the fluid of the second micro-channel and the apex electrode, and exchanging species between the fluid of the first and the second micro-channel and the surface of the substrate.

The proposed scanning micro-fluid device for an exchange of species with a surface may offer multiple advantages and technical effects:

The presented device is a device—which may also relate to a method—which may use electric fields to generate and control a motion of species (ions, molecules, particles or biological cells or parts thereof), and direct them to or from a target site in or on a substrate. Electro-kinetic actuation is achieved in two modes of their combination: (1) electrophoretic migration of ions and, (2) electron-osmotic flow. In the electrophoretic mode, molecules or particles may migrate under an electric field according to their electrophoretic mobility. In the electrodes osmotic mode, the motion of ions in the electrical double layer is directed, driving a flow of the solution in the bike, which moves the species of interest along with it. The use of electro-kinetic actuation mechanisms does not require any mechanical actuation mechanism, such as treasures sources or syringe pumps, and relies on a direct application of electric fields to achieve a mechanical motion.

The apex electrode may also be seen as a reference electrode allowing an individual setting of electrical fields in the two micro-channels. Additionally, the device may be regarded as a micro-fluid chip because of its small dimensions and the close proximity of the ends/apertures of the micro-channels which may be seen as orifices.

By applying different electrical fields in the different channels, by which the flow rate in the micro-channels may be controllable or adjustable, the size of the confined liquid may be controlled. Although the general size of the confinement may be defined by the mechanical parameters of the device; its basic lengths scale may be defined by the geometry of the channel apertures, in particular, the distance between the inlet and the outlet, the aperture dimensions, and the apex-to-surface.

The proposed device may be capable of placing a defined position of molecules, including but not limited to, a deposition and patterning of proteins, nucleated acids, cells, beads and/or other particles. Additionally, it is possible to locally remove molecules from the surface of the substrate or from within the substrate, including but not limited to, a dissociation of proteins, melting of nucleic acids, and an extraction of the content. This surface processing may be achieved using both, chemical processing by the solution directed to the surface and electric excitation such as electroporation of the cell membrane and electrostatic interactions.

Hence, the proposed device can be used to process biological specimens, such as tissue sections or adherent cells which can be electrically excited or electroporated using the electrical field inherent to the operation of the device. Such processing may include a delivery of reagents into the cells, cell transfection, a labeling of intracellular components, as well as, extraction of components from the cell. When the aforesaid extracted components are directed away from the surface, they may be post-processed within or on the device. Such post-processing may comprise, but is not limited to, focusing, separation and quantification.

In the following, additional embodiments of the device—also applicable to the related method—are explained:

According to embodiments of the invention, the exchange of species between the fluid of the first and the second micro-channel and the surface of the substrate comprise a delivery of species to the surface and/or an extraction of species from the surface. Thus, both options, a deposition of species and an extraction of species from the surface may be possible alternatively, or in combination. This may allow a high degree of flexibility in the usage of the device. Thus, the device may not only allow to transport one kind of species to the surface and other species away, but also a deliver to the surface and an extraction of the same species from the surface.

According to embodiments of the invention, the different voltage levels create an electrical field resulting in a transport mechanism within or of the fluid. The electrical field(s) between the different electrodes allow a direct influence on the fluid and its behavior. The behavior, e.g., a speed of transport, may be influenced by the intensity of the electrical field(s).

According to embodiments of the invention, the transport mechanism may be based on electrophoresis and/or electroosmosis. Thus, these effects based on the electrical field may be used as a single phenomenon or in combination. Also, this helps increase the flexibility of the device.

According to embodiments of the invention, the device may also comprise a first reservoir at a second end of the first micro-channel and/or a second reservoir at a second end of the second micro-channel. Hence, the fluid is not limited to the amount of fluid in the micro-channels and in the apex area, but a large amount of fluid is available in order of a more continues operation of the device. Therefore, the device may stay in operation for a longer time, so that more species may be deposited (or extracted) on the surface.

According to embodiments of the invention, the first electrode ends in the first reservoir partially filled with the fluid and/or the second electrode ends in the second reservoir partially filled with the fluid. Therefore, the respective electrodes may stay in contact with the fluid even under the influence of increasing or decreasing fluid levels in the reservoirs. However, the electrodes—in particular, the first electrode and the second electrode—may have other forms like covering partially an inner surface of a micro-channel (in a ring-like structure). Also, the apex electrode may have different shapes, e.g., surrounding the apex area having different shapes.

According to embodiments of the invention, the fluid is hydro-dynamically confined between the apex area and the surface of the substrate within the intermediate immersion liquid. Thus, the fluid may not "escape" or vanish from the apex area. It may be seen as imprisoned by the immersion liquid. The surface tension of the liquid may keep the immersion liquid between an end of the body of the device and a carrier for the substrate and/or the substrate itself.

According to embodiments of the invention, the fluid may be a solution comprising at least one selected out of the group comprising ions, molecules, particles, cells, deoxyribonucleic acid (DNA), ribonucleic acid (RNA), peptide nucleic acids (PNA), locked nucleic acids (LNA), bridged nucleic acids (BNA), proteins, antibodies, aptamers, metabolites, annexins, clathrins, integrins and hybrids comprised of at least one of aforementioned. Thus, very different chemical or biological material may be deposited (extracted) to the surface of the substrate. The device may address a broad spectrum of use cases.

According to embodiments of the invention, the substrate comprises at least one selected out of the group comprising glass slides, thermoplastic polymers, ceramics, elastomers, viscoelastic polymers—in particular, such as polydimethylsiloxane (PDMS)—and biological specimens—in particular, such as tissue sections, cell cultures, and adherent cells. Consequently, a large variety of materials for the substrate may be used allowing for a broad applicability of the proposed device and method.

According to embodiments of the invention, the first micro-channel and the second micro-channel may be embedded into a device body. This may enable reproducible conditions, and it may allow integrating the electrodes directly into the same body as the micro-channels.

According to embodiments of the invention, the device may also comprise at least one module adapted for focusing, separation and/or quantification of species. Thus, more active components may be integrated with the micro-fluid device extending the usage scope and the potential used cases of the device.

BRIEF DESCRIPTION OF THE DRAWINGS

It should be noted that embodiments of the invention are described with reference to different subject-matters. In particular, some embodiments of the invention are described with reference to method type claims, whereas other embodiments of the invention are described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be disclosed within this document.

The aspects defined above, and further aspects of the present invention, are apparent from the examples of embodiments of the invention to be described hereinafter and are explained with reference to the examples of embodiments of the invention, but to which the invention is not limited.

Figure 1:
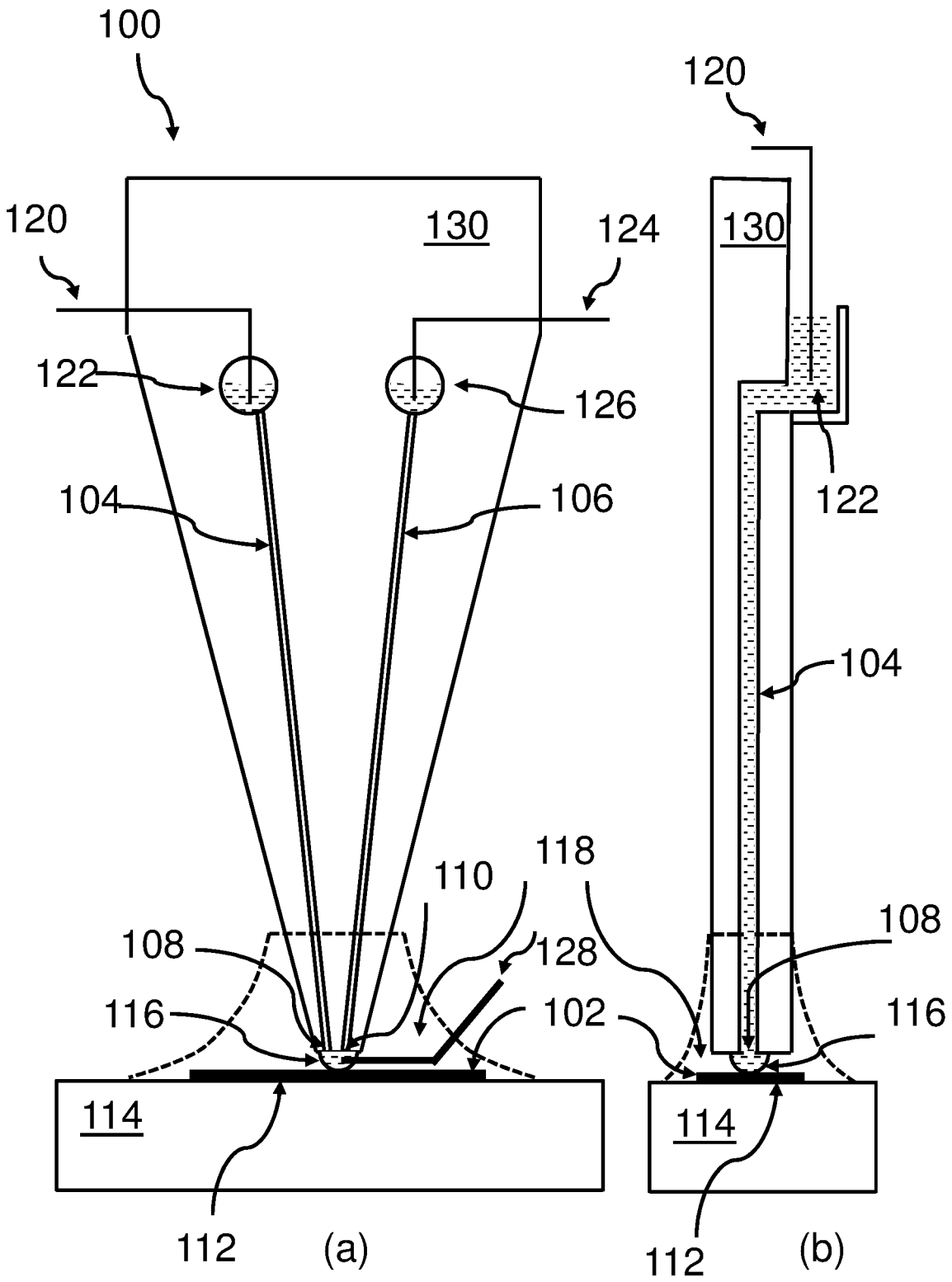
Figure 2A:
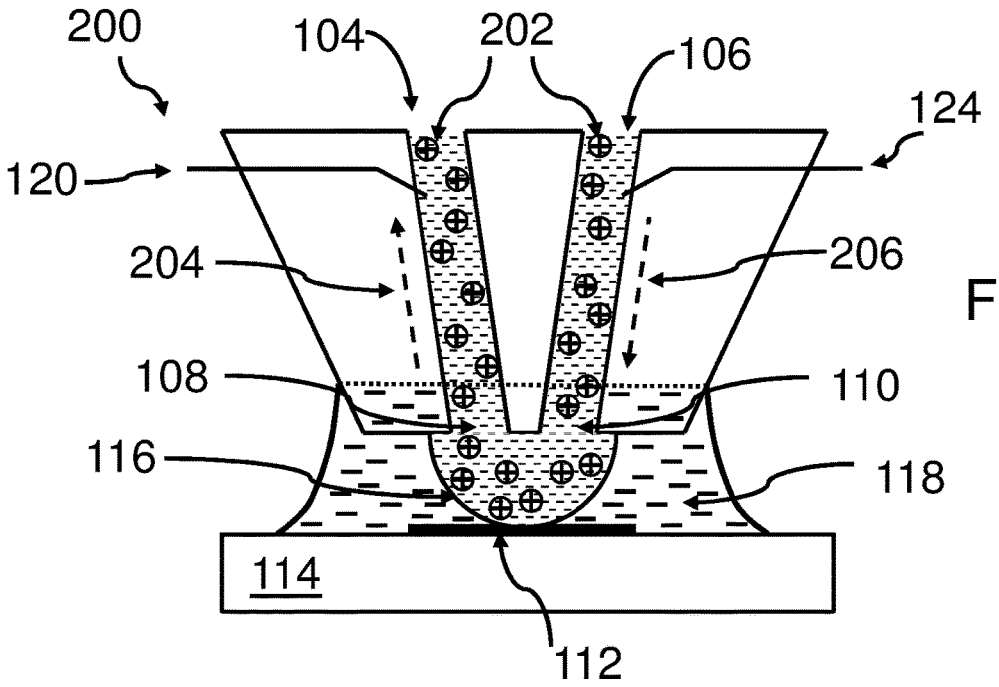
Figure 2B:
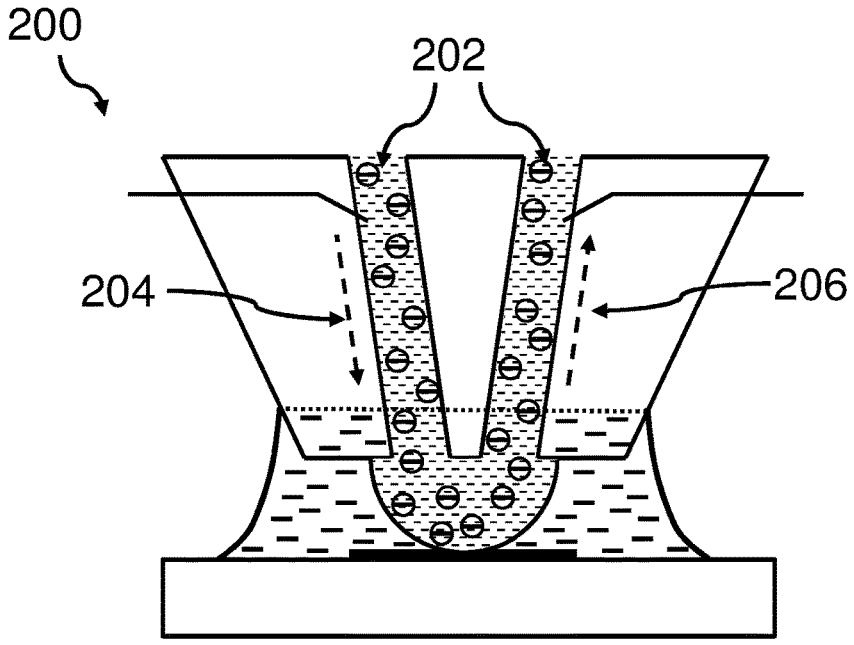
Figure 2C:
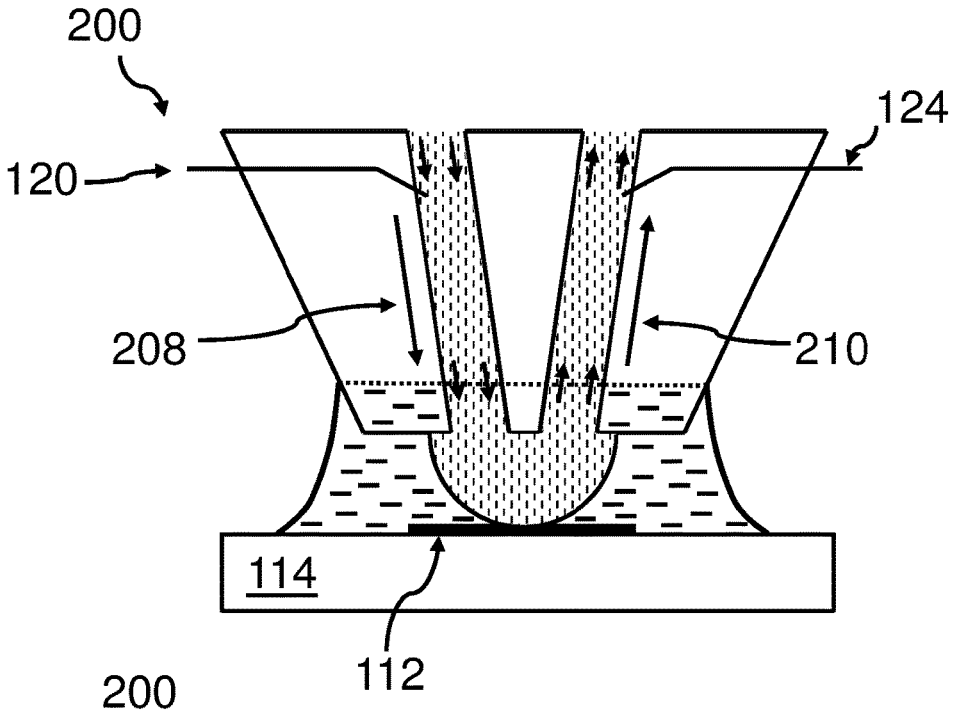
Figure 2D:
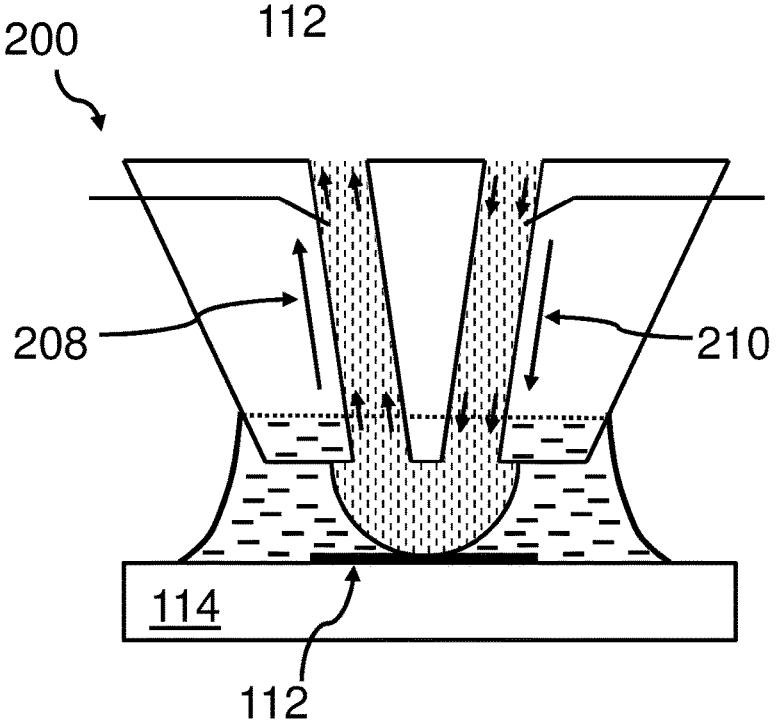
Figure 2E:
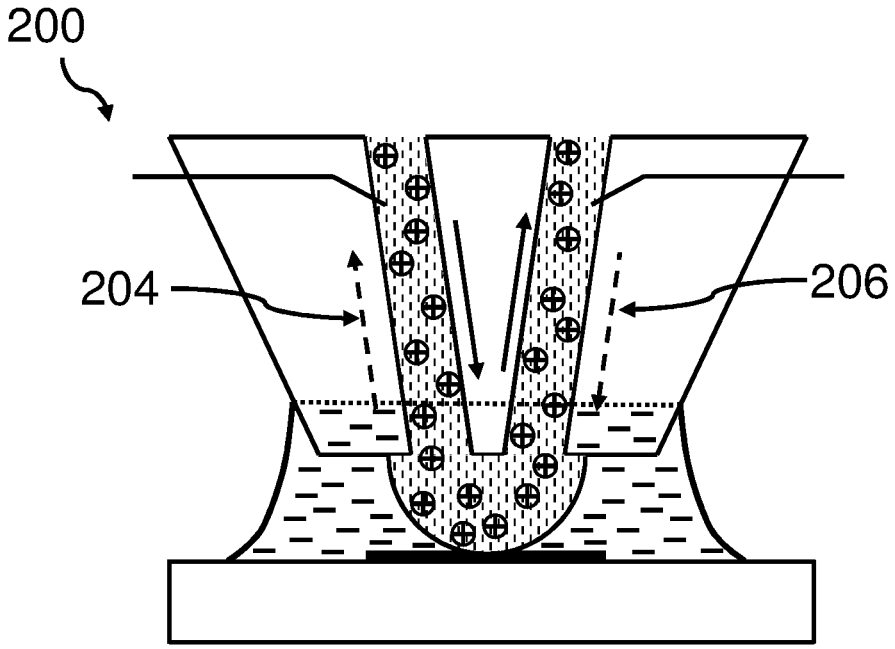
Figure 2F:
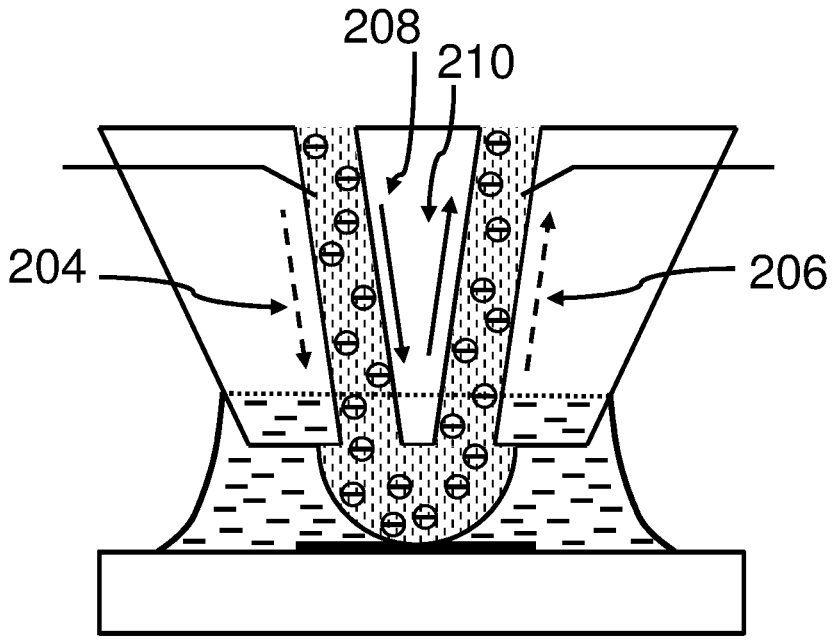

Embodiments of the invention will be described, by way of example only, and with reference to the following drawings:

FIG. 1 shows a block diagram of a scanning micro-fluid device for an exchange of species with a surface according to embodiments of the invention.

FIG. 2(*a*) is a schematic illustration of operation modes of the device according to embodiments of the invention.

FIG. 2(*b*) is a schematic illustration of operation modes of the device according to embodiments of the invention.

FIG. 2(*c*) is a schematic illustration of operation modes of the device according to embodiments of the invention.

FIG. 2(*d*) is a schematic illustration of operation modes of the device according to embodiments of the invention.

FIG. 2(*e*) is a schematic illustration of operation modes of the device according to embodiments of the invention.

FIG. 2(*f*) is a schematic illustration of operation modes of the device according to embodiments of the invention.

Figure 3:
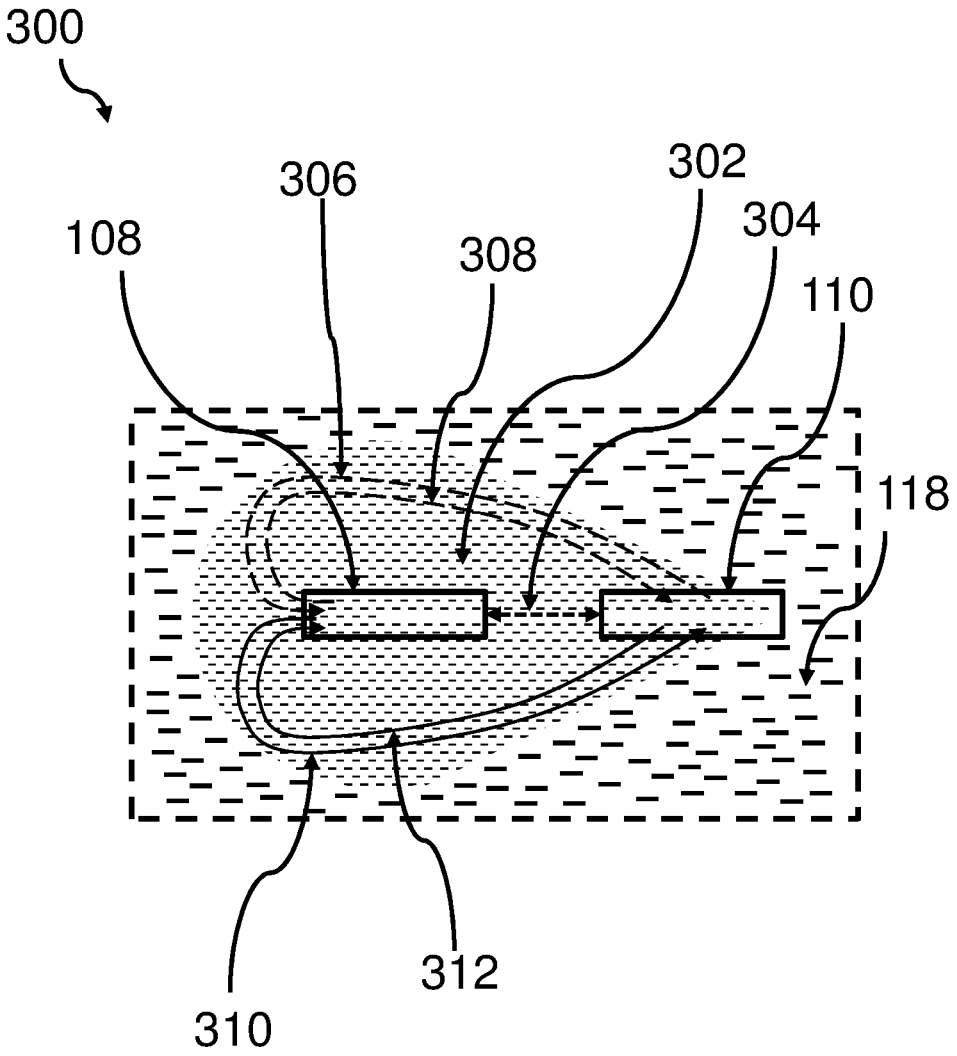

FIG. 3 is a schematic illustration showing a bottom portion of an electro-kinetic confinement on a substrate according to embodiments of the invention.

Figure 4:
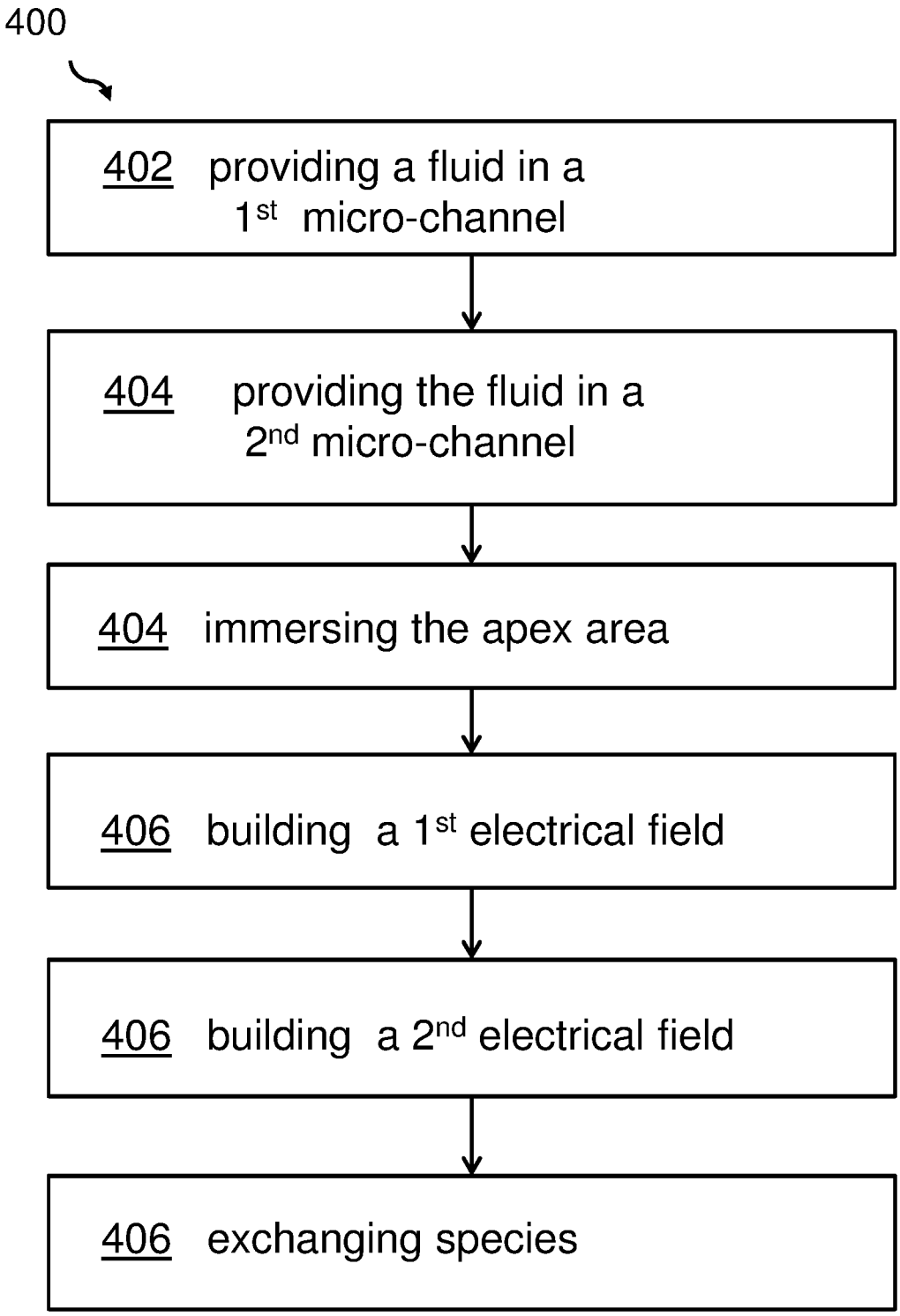

FIG. 4 shows a flowchart of a method for an exchange of species with a surface according to embodiments of the invention.

DETAILED DESCRIPTION

In the context of this description, the following conventions, terms and/or expressions may be used:

The term "exchange" may denote that species may be interchanged between the surface and the fluid. The species may be transported in the fluid so that one sort of species may be brought to the surface and at the same time other species may be transported away from the surface. Actually, it may be the same species which may have caused or catalyzed a reaction on the surface and/or the bulk of the substrate. Any kind of exchange may be possible.

The term "interaction" may denote—in particular an exchange of species—and may also be interpreted widely. An interaction may comprise a deposition or an extraction of species. It may also comprise a reaction of species with components of the surface (or a substrate itself or a layer thereof). Thus, species may be transported to the surface, may cause a reaction within the surface and may then be transported away through the other micro-channel.

The term "surface" may denote a top surface of a substrate. The substrate may comprise a wide variety of materials like glass slides, thermoplastic polymath, ceramic material, elastomers, viscoelastic elastomers and/or biological specimens which are placed on top of a substrate such as a tissue section or adherent cells.

The term "micro-channel" may denote a channel or a cube in the micro-device. Its diameter may be in the range of about 10 μm to about 100 μm. The micro-channel may end in a reservoir (top end), and at the apex area of the device. More than two micro-channels may also be possible.

The term "fluid" may denote any liquid able to build a solution in which ions may move freely. Typically, the solutions may be water-based. However, also other carrier liquid for the solution may be selected.

The term "apex area" may denote an active area of the hear proposed device. It may be the culmination point in which apertures of the micro-channels are in close proximity to each other and to the surface of a substrate in the apex area. The fluid from one micro-channel may be in liquid contact with the liquid of the other micro-channel.

The term "intermediate immersion liquid" may denote comparably small amounts of liquid—but clearly more than the fluid of the apex area—surrounding the apex area. Due to the surface tension of the immersion liquid, the complete apex area is hydrodynamically confined within the immersion liquid.

The term "electrode" may denote an electrical contact surrounded by a fluid, in particular a fluid of the first and/or second micro-channel and/or the apex area. The electrode may be made from any conductive material like platinum, copper or aluminum.

The term "electrophoresis effect" may denote the motion of dispersed particles relative to a fluid under the influence of a spatially uniform electric field. The motion is ultimately caused by the presence of a charged interface between the particle surface and the surrounding fluid. It is the basis for a number of analytical techniques used in chemistry for separating molecules by size, charge, or binding affinity.

The term "electro-osmosis"—also denoted as Electroosmotic flow (or electro-osmotic flow, often abbreviated EOF)—may denote the motion of liquid induced by an applied potential across a porous material, capillary tube, membrane, microchannel, or any other fluid conduit. Because electroosmotic velocities are independent of conduit size as long as the electrical double layer is much smaller than the characteristic length scale of the channel, electroosmotic flow may have little effect. Electroosmotic flow is most significant when in small channels. Electroosmotic flow is an essential component in chemical separation techniques, notably capillary electrophoresis. Electroosmotic flow can occur in natural unfiltered water, as well as buffered solutions. The electric double layer (EDL) is a layer forming on the channel wall when an aqueous solution gets in contact with it, typically 1-100 nm in width. This layer may have a high density of charges or ions opposite in their charge to the charge of the wall. When an electric field is applied, these charges exert electric forces on the bulk fluid and generate a uniform flow in the channel—this is the electro-osmotic flow (EOF).

In the following, a detailed description of the figures will be given. All instructions in the figures are schematic. Firstly, a block diagram of an embodiment of the inventive scanning micro-fluid device for an exchange of species with a surface is given. Afterwards, further embodiments, as well as embodiments of the method for an exchange of species with a surface, the method, will be described.

FIG. 1*a* shows an embodiment of the inventive scanning micro-fluid device 100 for an exchange of species with a surface 102. Thus, it may be possible to deposit selected species on the surface 102 or extract selected species from the surface 102.

FIG. 1*b* shows the same scanning micro-fluid device 100 turned by 90°, and in particular a cross-section of the device 100 (here shown as dashed lines).

The device 100 comprises a first micro-channel 104, filled with a fluid, and a second micro-channel 106 comprising the fluid. In FIG. 1*b* the cross-section shows one of the two micro-channels filled with the fluid.

The first micro-channel 104 comprises at its first end a first aperture 108 and the second micro-channel 106 comprises at its first end a second aperture 110. The first and the second aperture have a predefined distance to each other in an apex area 116 in proximity of the surface 102 of a substrate 112. The substrate 112 may be positioned on top of a carrier 114.

The surface 102, the apex area 116 comprising the first aperture 108 of the first micro-channel 104 and the second aperture 110 of the second micro-channel 106 is immersed with an intermediate immersion liquid 118.

A first electrode 120 reaches into the fluid on the first micro-channel 104, in particular, into a reservoir 122 which is in a fluid exchange with the first micro-channel 104. Thus, a second end (or top end) of the first micro-channel 104 ends in the first reservoir 122 which is partially filled with the fluid (shown as dashed lines within the reservoir).

A second electrode 124 reaches into the fluid on the second micro-channel 106, and in particular, into a reservoir 126 which is in a fluid exchange with the second micro-channel 106. Thus, a second end (or top end) of the second micro-channel 106 ends in the second reservoir 126 which is partially filled with the fluid (shown as dashed lines within the reservoir).

An apex electrode 128 reaches into the apex area 116. Different voltage levels are applicable to the first electrode 120, the second electrode 124, and the apex electrode 128. Thus, electrical fields can be generated within the fluid, in particular, between the apex area 116 and the first reservoir 122, as well as between the apex area 116 and the second reservoir 126. Additionally, micro-channels with additional reservoirs and respective electrodes are possible.

A typical distance between the apertures of the micro-channels 104, 106 may be in the range of 5 to 600 μm. Another design component, the width of the micro-channels—being typically in the range of 10 to 100 μm—may be used in order to influence key parameters of the device's behavior.

This way, species in the fluid, which may be a solution comprising the species, may be moved within the fluid by the influence of the electric field, i.e., by electrophoresis effects, and/or the fluid itself may be moved by the influence of the electrical field, i.e., by electro-osmosis effects.

It may also be noted that it is assumed that FIG. 1*b* provides a view onto the left side on the device 100. Thus, the first micro-channel 100 for the first reservoir 122, as well as, the first electrode 120 is visible. It may also be noted that the micro-channel 104, 106 may be integrated into a body 130 (solid or frame-style) of the device 100. The reservoirs 122, 126 may also be integrated into the body 130 or they may be attached (completely or partially) to a surface of the body 130. The apex area 116 may reach to the surface 102 of the substrate 112, such that an exchange of species becomes possible.

FIGS. 2(*a*), (*b*), (*c*), (*d*), (*e*), (*f*) show all the bottom end 200 of the body 130, in particular, a bottom end of the micro-channel 104 with its respective first aperture 108, a bottom end of the micro-channel 106 with its respective second aperture 110, the apex area 116 (shown as a half circle comprising the fluid fluidly-connecting the fluid comprised in the first micro-channel and the second micro-channel).

One may also see ions 202 of species comprised in the fluid of the micro-channels 104, 106, as well as, in the apex area 116. Only the electrodes 120 and 124 are shown schematically; however, the arrows 204 and 206 indicate a movement of the ions (as example, positive ions are shown) downstream in the second micro-channel 106 and upstream in the first micro-channel 104 due to electrophoresis effects. The enlarged view of FIG. 2(*a*) indicates that the apex area 116, comprising the ions of the fluid, touch the surface of the substrate 112, enabling an interaction, in particular, an exchange (deposition and/or extraction) of the ions with the surface.

It may also be enabled that different ions may be deposited on the surface 102 and extract at the same time depending on the concentration of the different ions in the fluid. Also, other interactions may be enabled this way.

The first electrode 120 and the second electrode 124 are only shown symbolically reaching into the first micro-channel 104 and the second micro-channel 106. Actually, they reach in the respective reservoirs 122, 126, as shown in FIG. 1. Additionally, for simplicity reasons the apex electrode 128 is not shown in FIG. 2, although this electrode may be useful for the functioning of the device 100.

FIG. 2(*b*) shows a comparable situation as in FIG. 2(*a*). The only difference is that the ions 202 have a different polarity (negative) and thus, the arrows 202, 206 are pointing into the opposite direction, assuming that the voltages, applied to the electrodes 120, 124, 126, have not changed its direction.

FIG. 2(*c*) and FIG. 2(*d*) show the same bottom end 200 of the body 130, as FIGS. 2(*a*) and 2(*b*) do. However, here not any ions moving in an electrical field are shown, but the fluid itself is moving under the influence of the electrical field applied by the electrodes 120, 124, 128 based on the electro-osmotic effect. The only difference between FIGS. 2(*c*) and 2(*d*) is that the direction of the motion of the fluid—indicated by the arrows 208 and 210—is opposite to each other.

FIG. 2(*e*) and FIG. 2(*f*) show a combination of the electrophoresis effect—in particular, showing a movement of positive ions—and the electro-osmotic effect—in particular, showing a movement of the fluid itself. It turns out that depending on the polarity of the ions—as well as, the polarity of the electrical fields—a co-linear movement of ions and the fluid, as well as, a movement in opposite directions of the ions and the fluid may be achieved.

FIG. 3 shows a schematic drawing of the confinement of the solution 302 of the fluid in the intermediate liquid 118 (immersion liquid) between the first aperture 108 of the first micro-channel 104 and the second aperture 110 of the second micro-channel 106. The apertures 108, 110 are located in the apex area 116, at a distance 304 from each other. The migration of ions and the solution (the fluid) is directed from the left, first aperture 108 to the right second aperture 110. The dashed arrow 306 indicates the direction of the electrical field from the second aperture 110 to the first aperture 108 in case of opposed directions of electrophoretic forces and electro-osmotic flow; the dashed arrow 308 indicates the direction of the electrical field from the first aperture 108 to the second aperture 110 in case of a co-directional migration. A typical distance is in the range of 5 μm to about 600 μm, also depending on the diameter of the micro-channels.

The continuous arrow 310, 312 indicate the direction of the osmotic flow.

The motion/movement of the ions and/or the fluid can be made visible with fluorescence images. Experiments have been made with different parameters, in particular with 50 μM fluorescein (having an electrophoretic mobility of $25\times10^{-9}$ $m^2V_{-1}s^{-1}$) solution in glass channels (having an estimated zeta potential of −65 mV at a pH-value of 7). The exemplary applied electrical fields are $E=-33\times10^3$ V/m across the second micro-channel 110 and $E1=1.67\times10^3$ V/m, $E2=3.33\times10^3$ V/m, $E3=6.67\times10^3$ V/m, and $E4=10\times10^3$ V/m across the first micro-channel 108.

It may also be noted that one or more additional electrodes which are in contact with the intermediate immersion liquid may be used. These electrodes may be fixed or they may be mobile.

In another embodiment of the invention, parts of all of the electrodes may be printed to the surface of the body 130. The printed pattern may have various shapes, including, but not limited to, a point electrode, a tablet point electrodes, and may surround the apex area in the shape of a rectangle or circle. In such an embodiment of the invention, a motion of the apex area relative to the additional electrodes may be used to change the shape of a confinement pattern of the immersion liquid.

In a further embodiment of the invention, the additional electrodes may be printed to the device, in the vicinity of the apex area or are physically attached to the device body. In such an embodiment of the invention, the motion of the apex (in particular, the apex area) may be coupled to a motion of the electrodes and the shape of the confinement is, thus, independent of the apex area location.

The electrodes may be made of any conductive material, including but not limited to, platinum, aluminum or copper.

FIG. 4 shows a block diagram of an flowchart detailing the proposed method 400 for an exchange of species with a surface and with an intermediate immersion liquid. The method comprises providing, 402, a fluid in a first micro-channel, and providing, 404, a second micro-channel comprising the fluid. The first micro-channel comprises at its first end a first aperture and the second micro-channel comprises at its a first end a second aperture. The first aperture and the second aperture have a distance to each other in an apex area in a proximity of the surface of a substrate.

The method 400 comprises further immersing, 406, the apex area with the intermediate immersion liquid, and building, 408, a first electrical field between a first electrode reaching into the fluid of the first micro-channel and an apex electrode, whereby the apex electrode reaches into the apex area.

Additionally, the method 400 comprises building, 410, a second electrical field between a second electrode reaching into the fluid of the second micro-channel and the apex electrode, and exchanging, 412, species between the fluid of the first and the second micro-channel and the surface of the substrate.

In the following, a plurality of application areas of the device and the related method will be discussed:

Surface patterning: In one embodiment of the invention, the device is used to pattern a surface with one or more species of interest. Such patterning may be achieved through deposition of species on the surface, or through chemical reactions with the surface. In this way, the device can be used to deposit biological species such as antibodies, nucleic acids, proteins, or aptamers, thus creating biologically functionalized surfaces. In another embodiment of the invention, the device is used to deposit conductive material on the surface, thus creating surface electrodes.

Measuring species properties: In another embodiment of the invention, the device is used to measure the electrophoretic mobility and concentration of one or several species present in the solution, based on the confinement size and shape of each species. One or more of the species may be labelled fluorescently or calorimetrically, with optical imaging used to observe the confinement.

Measuring species interactions: In another embodiment of the invention, one or more of the species can bind with one another, and the device is used to quantify such binding. For example, if a fluorescently labeled antibody is mixed together with an antigen, the mobility of the complex may be different from the individual component, resulting in a different confinement pattern thus allowing detection and quantification of the binding. Other embodiments of the invention include measurement of protein-protein interactions, aptamer-protein interactions, nucleic acid interactions, peptide nucleic acid (PNA)-nucleic acid (DNA or RNA) interactions, and morpholinos-nucleic acid interactions.

Local environment: In one embodiment of the invention, the device is used to change the local environment on the surface. For example, by delivering acidic or basic species, the local pH in the confinement region may be modified.

Surface reactions—association: In another embodiment of the invention, species contained in the solution directed towards the surface through first channel react with the surface, or a surface-based sample, resulting in association with species on the surface. For example, if the surface is pre-patterned with antibodies or nucleic acid probes, the device can be used to deliver a test sample which may contain matching proteins or nucleic acid sequences, thus implementing an immunoassay or genetic test. Species participating in the association include, but are not limited to, deoxyribonucleic acid (DNA), ribonucleic acid (RNA), peptide nucleic acids (PNA), locked nucleic acids (LNA), bridged nucleic acids (BNA), proteins, antibodies, aptamers, metabolites, and hybrids comprised of at least one of aforementioned. In another embodiment of the invention, the device is used to deliver species associating with cell or vesicle membrane, including but not limited to, membrane binding antibodies and proteins such as annexins, clathrins, and integrins. These reactions can also be used to measure cellular activity, for example, using calcium- or magnesium-regulated proteins. In another embodiment of the invention, species contained in the solution, penetrate the cell membrane, for example using chemical digestion or electro- or chemical poration of the cell membrane, and associate with intracellular components including but not limited to metabolites, nucleic acids, or proteins, gene transfection and fluorescence in-situ hybridization (FISH) of DNA, RNA, or PNA. Other embodiments invention include a deposition of species to alter the surface properties of the processed substrate, e.g., a deposition of polyelectrolytes to change wall potential.

Surface reactions—dissociation: In another embodiment of the invention, species delivered to the surface drive dissociation of species present on the surface, or the surface-based sample. For example, if the surface is patterned with complexes of nucleic acids or proteins, following a previous reaction, the device can be used to melt the hybrid or remove the whole complex from the surface. Dissociated species can include, but are not limited to proteins, antibodies, aptamers, deoxyribonucleic acid (DNA), ribonucleic acid (RNA), peptide nucleic acids (PNA), locked nucleic acids (LNA), bridged nucleic acids (BNA), cells, cell-antibody complexes and complexes containing at least one of aforementioned.

Electro- or chemical poration of cells:

In another embodiment of the invention, the device is used for electrical or chemical poration of cell membrane of cells contained on the substrate. Electroporation can be achieved by subjecting the cell to an AC or DC electric field at appropriate magnitude and frequency. Chemical poration can be achieved by bringing a solution containing organic solvents or detergents in contact with the membrane. These methods can be used to deliver species into the cell through the porous cell membrane or extract species from within the cell for downstream analysis or post processing.

Extractions: In another embodiment of the invention, the device can be used to extract the dissociated species from the substrate, and direct them away through the second channel for further post-processing. The extracted species may include cells, proteins or nucleic acids dissociated from the substrate, or intracellular components from the porous cells past electro- or chemical poration. In another embodiment of the invention, the same principle can be used to extract species from patient samples or live samples such as artificial organs or plants. The extracted species can serve as biomarkers indicating the occurrence of processes in the sample, e.g., metabolic processes and drug response.

Post processing or extracted species: In another embodiment of the invention, the extracted components are processed and analyzed in the second channel post extraction by electro-kinetic focusing. The processing includes on-chip or off-chip focusing of the species to increase their concentration, separation of species and their quantification. The electro-kinetic focusing or separation can be done by means of capillary electrophoresis, gel electrophoresis, isotachophoresis, or concentration polarization. Downstream processing may also include nucleic acid amplification methods such as polymerase chain reaction (PCR), rolling circle amplification (RCA), loop-mediated isothermal amplification (LAMP), strand displacement amplification (SDA), multiple displacement amplification (MDA), or ligase chain reaction (LCR).

Types of substrates: In another embodiment of the invention, the processed substrates, include but are not limited to, hard surfaces such as glass slides, thermoplastic polymers, ceramics, elastomers, viscoelastic polymers such as polydimethylsiloxane (PDMS), and biological specimens such as tissue sections, cell cultures, and adherent cells.

Device design: In another embodiment of the invention, more advanced designs of channels can be used to shape the confinement and add functionality. For example, the distance between the orifices can be decreased to achieve a smaller confinement size or the dimensions and aspect ratio of the channel orifices can also be used to create a wider or narrower confinement. In another embodiment of the invention, channels can be concentric thereby creating circular or ring-shaped confinement on the surface. To add additional functionalities or multiplexing abilities, more than one channel can be used to direct species towards the surface, and more than one channel can be used to direct species away from the surface the orifices of the channels can be shaped in different configurations such that more than one confinement is created simultaneously or different species from each channel are directed to different regions or react at a certain region within a confinement. In another embodiment of the invention, the device may be constructed from materials that include, but are not limited to, glass, elastomers, thermoplastic polymers, ceramics, Teflon, polydimethylsiloxane (PDMS), and combinations comprising at least one of the aforesaid materials. In another embodiment of the invention, the solution containers can be implemented as integrated on-chip reservoirs or located off-chip.

Device operation: In another embodiment of the invention, the device can be operated at different orientations, when forming an angle between the apex and the substrate, or facing sideways, such that the channels are horizontal or tilted, and the substrate is tilted vertically. This configuration is applicable in particular in systems in which interfacial forces are dominant. In configurations in which the apex of the device is forming an angle with the substrate, the confinement shape and location are affected and it is shifted sideways from the center of the apex. The confinement can also be shaped by applying a solution having a different conductivity than that of the intermediate solution. In another embodiment of the invention, the device can be coupled with an XY stage, used to scan the substrate manually or automatically. Such automatization can be used for a deposition or an extraction from multiple sites and a creation of pre-programmed patterns on the substrate. Other embodiments of the invention include the use of a substrate carried by a transparent surface, and observing the confinement from the other side, for example using an inverted microscope, or laterally in case of a tilted orientation.

The descriptions of the various embodiments of the present invention have been presented for purposes of illustration but are not intended to be exhaustive or limited to the embodiments disclosed. Many modifications and variations will be apparent to those of ordinary skills in the art without departing from the scope and spirit of the described embodiments of the invention. The terminology used herein was chosen to best explain the principles of the embodiments, the practical application or technical improvement over technologies found in the marketplace, or to enable others of ordinary skills in the art to understand the embodiments disclosed herein.

The present invention may be embodied as a system, a method, and/or also in combination with a computer program product. The computer program product may include a computer readable storage medium (or media) having computer readable program instructions thereon for causing a processor to carry out aspects of the present invention. The medium may be an electronic, magnetic, optical, electromagnetic, infrared or a semi-conductor system for a propagation medium. Examples of a computer-readable medium may include a semi-conductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W), DVD and Blu-Ray-Disk.

The flowcharts and/or block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or act or carry out combinations of special purpose hardware and computer instructions.

The terminology used herein is for the purpose of describing particular embodiments only and is not intended to limit the invention. As used herein, the singular forms "a", "an" and "the" are intended to include the plural forms as well, unless the context clearly indicates otherwise. It will further be understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or steps plus function elements in the claims below are intended to include any structure, material, or act for performing the function in combination with other claimed elements, as specifically claimed. The description of the present invention has been presented for purposes of illustration and description but is not intended to be exhaustive or limited to the invention in the form disclosed. Many modifications and variations will be apparent to those of ordinary skills in the art without departing from the scope and spirit of the invention. The embodiments are chosen and described in order to best explain the principles of the invention and the practical application, and to enable others of ordinary skills in the art to understand the invention for various embodiments with various modifications, as are suited to the particular use contemplated.

What is claimed is:

1. A scanning micro-fluid device for an exchange of species with a surface and an intermediate immersion liquid, said device comprising:

a first micro-channel comprising a fluid;

a second micro-channel comprising said fluid;

wherein said first micro-channel comprises at its first end a first aperture and wherein said second micro-channel comprises at its first end a second aperture, said first and said second aperture having a distance to each other in an apex area in a proximity of said surface of a substrate;

wherein said surface, said apex area comprising said first aperture of said first micro-channel and said second aperture of said second micro-channel is immersed with said intermediate immersion liquid;

a first electrode reaching into said fluid in said first micro-channel;

a second electrode reaching into said fluid in said second micro-channel; and an apex electrode reaching into said apex area;

wherein different voltage levels are applicable to said first, said second and said apex electrode;

wherein the apex electrode reaches into the apex area such that species are exchangeable between said fluid of said first and said second micro-channel and said surface of said substrate.

2. The device according to claim 1, wherein said exchange of species between said fluid of said first and said second micro-channel and said surface of said substrate comprises a delivery of species to said surface and/or an extraction of species from said surface.

3. The device according to claim 1, wherein said different voltage levels create an electrical field resulting in a transport mechanism within or of said fluid.

4. The device according to claim 3, wherein said transport mechanism is based on electrophoresis and/or electro-osmosis.

5. The device according to claim 1 further comprising a first reservoir at a second end of said first micro-channel and/or a second reservoir at a second end of said second micro-channel.

6. The device according to claim 5, wherein said first electrode is located in said first reservoir partially filled with said fluid and/or said second electrode is located in said second reservoir partially filled with said fluid.

7. The device according to claim 1, wherein said fluid is hydro-dynamically confined between said apex area and said surface of said substrate within said intermediate immersion liquid.

8. The device according to claim 1, wherein said fluid is a solution selected from a group consisting of ions, molecules, particles, cells, deoxyribonucleic acid (DNA), ribonucleic acid (RNA), peptide nucleic acids (PNA), locked nucleic acids (LNA), bridged nucleic acids (BNA), proteins, antibodies, aptamers, metabolites, annexins, clathrins, integrins and hybrids comprised of at least one of aforementioned.

9. The device according to claim 1, wherein said substrate is selected from a group consisting of glass slides, thermoplastic polymers, ceramics, elastomers, viscoelastic polymers, and biological specimens.

10. The device according to claim 1, wherein said first micro-channel and said second micro-channel is embedded into a device body.

11. The device according to claim 1 further including at least one module adapted for focusing, separation and/or quantification of species.

12. A method for an exchange of species with a surface and with an intermediate immersion liquid, said method comprising:

providing a fluid in a first micro-channel;

providing a second micro-channel comprising said fluid;

wherein said first micro-channel comprises at its first end a first aperture and wherein said second micro-channel comprises at its a first end a second aperture, said first aperture and said second aperture having a distance to each other in an apex area in a proximity of said surface of a substrate;

immersing said apex area with said intermediate immersion liquid;

building a first electrical field between a first electrode reaching into said fluid of said first micro-channel and an apex electrode, said apex electrode reaching into said apex area;

building a second electrical field between a second electrode reaching into said fluid of said second micro-channel and said apex electrode; and exchanging species between said fluid of said first and said second micro-channel and said surface of said substrate.

13. The method according to claim 12, wherein said exchanging of species between said fluid of said first and said second micro-channel and said surface of said substrate comprises a delivery of species to said surface or an extraction of species from said surface.

14. The method according to claim 12, wherein said first electrical field and said second electrical field result in a transport mechanism within or of said fluid.

15. The method according to claim 14, wherein said transport mechanism is based on electrophoresis and/or electro-osmosis.

16. The method according to claim 12 further comprising providing a first reservoir at a second end of said first micro-channel and/or a second reservoir at a second end of said second micro-channel.

17. The method according to claim 16, wherein said first electrode ends in said first reservoir partially filled with said fluid and/or said second electrode ends in said second reservoir partially filled with said fluid.

18. The method according to claim 12, wherein said fluid is hydro-dynamically confined between said apex area and said surface of said substrate within said intermediate immersion liquid.

19. The method according to claim 12, wherein said fluid is a solution selected from a group consisting of ions, molecules, particles, cells, deoxyribonucleic acid (DNA), ribonucleic acid (RNA), peptide nucleic acids (PNA), locked nucleic acids (LNA), bridged nucleic acids (BNA), proteins, antibodies, aptamers, metabolites, annexins, clathrins, integrins and hybrids comprised of at least one of aforementioned.

20. The method according to claim 12, wherein said substrate is selected from a group consisting of glass slides, thermoplastic polymers, ceramics, elastomers, viscoelastic polymers, and biological specimens.

* * * * *